US008047112B2

(12) United States Patent
Wu

(10) Patent No.: US 8,047,112 B2
(45) Date of Patent: Nov. 1, 2011

(54) HOLE-PIERCING PUNCH

(75) Inventor: Xiao Dong Wu, Tokyo (JP)

(73) Assignee: Plus Stationery Corporation, Tokyo (JP)

( * ) Notice: Subject to any disclaimer, the term of this patent is extended or adjusted under 35 U.S.C. 154(b) by 351 days.

(21) Appl. No.: 12/055,806

(22) Filed: Mar. 26, 2008

(65) Prior Publication Data

US 2008/0236357 A1 Oct. 2, 2008

(30) Foreign Application Priority Data

Mar. 30, 2007 (JP) ..... 2007-094027

(51) Int. Cl.
*B26F 1/32* (2006.01)

(52) U.S. Cl. ..... 83/633; 83/684

(58) Field of Classification Search ..... 83/633, 83/634, 635, 684, 686, 687
See application file for complete search history.

(56) References Cited

U.S. PATENT DOCUMENTS

| | | | | |
|---|---|---|---|---|
| 926,261 | A * | 6/1909 | Krag | 83/588 |
| 2,328,558 | A | 9/1943 | Kipp | |
| 2,445,093 | A * | 7/1948 | Von Cseh | 83/633 |
| 7,331,266 | B2 * | 2/2008 | Chen | 83/633 |

FOREIGN PATENT DOCUMENTS

| | | | |
|---|---|---|---|
| CH | 289712 | A | 3/1953 |
| DE | 702572 | C | 2/1941 |
| GB | 418607 | | 10/1934 |
| GB | 2185208 | A | 7/1987 |
| GB | 2302518 | A | 1/1997 |
| JP | 08-141995 | A | 6/1996 |
| JP | 2002-331496 | | 11/2002 |
| JP | 2006-198684 | A | 8/2006 |

* cited by examiner

*Primary Examiner* — Stephen Choi
(74) *Attorney, Agent, or Firm* — Edwards Angell Palmer & Dodge LLP

(57) ABSTRACT

The pivoting shaft of a handle member has an axial center position in a support platform that is substantially fixed, and the position with respect to the handle member is to be displaceable. Furthermore, as for a support shaft, the position in the handle member is fixed, and the axial center of the pivoting shaft is positioned near a perpendicular bisector of a segment connecting both ends of a support shaft-guiding hole.

9 Claims, 9 Drawing Sheets

HOLE-PIERCING PUNCH

BACKGROUND OF THE INVENTION

1. Field of the Invention

The present invention relates to a hole-piercing punch for piercing holes in paper sheets such as papers and sheets and particularly relates to an energy-saving configuration for reducing the hole-piercing load.

2. Description of the Related Art

A hole-piercing punch has been proposed for reducing the hole-piercing load. The hole-piercing punch has a base platform, support platform, handle, punching member, and the like. For example, for reducing the hole-piercing load, there is a hole-piercing punch with a handle (handling member) that is formed with maximum length. This handle is formed by being extended in the direction protruding from the base platform of the hole-piercing punch and is for applying a load on the punching member by which hole-piercing is carried out.

Furthermore, the following are other examples of hole-piercing punches to reduce the hole-piercing load. For example, the end opposite the end of a base platform side of a handle when carrying out hole-piercing with a hole-piercing punch is resumed to be a power point, and the pivoting shaft of the handle is a fulcrum. Furthermore, the punching member is an action point. Such a hole-piercing punch is formed so that the distance between the action point and the fulcrum becomes short and also the angle formed by the handle and the base platform becomes wide. With such a hole-piercing punch, increasing the force for acting on the action point may decrease the hole-piercing load.

Furthermore, another example of a hole-piercing punch for reducing the hole-piercing load is as follows. For example, there is a hole-piercing punch with a shifting fulcrum (hereinafter referred to as a "fulcrum-shifting punch") and a hole-piercing punch with a fixed fulcrum (hereinafter referred to as a "fulcrum-fixed punch"). It should be noted that "shifting fulcrum" means that the position of the pivoting shaft of the handle with respect to the support platform on the base platform is shifted, and "fixed fulcrum" means that the positional relation of the support platform and the pivoting shaft of the handle is approximately fixed.

Hereafter, the outline of a fulcrum-shifting punch is described using FIG. 1. FIG. 1A is a lateral view of a conventional fulcrum-shifting punch 200 when a punching member 211 starts descent. FIG. 1B is a lateral view of a conventional fulcrum-shifting punch 200 when finishing hole-piercing.

As shown in FIG. 1, a fulcrum-shifting punch 200 has a support platform 204 fixed onto the top surface of a base 202 by a securing fixture 203. The support platform 204 supports a handle 207 and a punching member 211. At one end of the support platform 204, a support shaft-guiding hole 205, having a longitudinal direction in the direction substantially orthogonal to the top surface of the base 202. Furthermore, at the other end of the support platform 204, a pivoting shaft-guiding groove 206, having a longitudinal direction in the direction substantially parallel to the top surface of the base 202.

Moreover, as shown in FIG. 1, at one end of the base 202 side of the handle 207, round hole 208 and round hole 209 are provided. The handle 207 is pivotably mounted onto the support platform 204 by inserting a pivoting shaft 210 into round hole 208 and the pivoting shaft-guiding groove 206 of the support platform 204. Furthermore, a support shaft 212 comprising a punching member 211 that extends in the same direction as the support shaft-guiding hole 205 is inserted into round hole 209 of the handle 207 and the support shaft-guiding hole 205 of the support platform 204 so as to be parallel to the top surface of the base 202.

Piercing of a hole in sheet materials such as paper sheets using the fulcrum-shifting punch 200 is performed by a user as follows. First, as shown in FIG. 1A, when the tip (blade part) of the punching member 211 is away from the top surface of the base 202 while no force is being applied to the handle 207 (power point) of the fulcrum-shifting punch 200, the user inserts paper sheets into the space 213 between the top surface of the base 202 and the support platform 204.

After the paper sheets are inserted by the user, the user presses down the handle 207 as shown in FIG. 1B. As a result of having been pressed down by the user, the handle 207 is pivoted with the pivoting shaft 210 acting as the fulcrum. The direction of the handle 207 to be pivoted by the user is the direction in which the tip of the handle 207 approaches the top surface of the base 202 (X1 direction in FIG. 1B).

When the handle 207 is pressed down, the support shaft 212 attached to the punching member 211 and inserted into round hole 209 shifts by being guided by the support shaft-guiding hole 205 of the support platform 204. The shifting direction of the support shaft 212 is the direction toward the top surface of the base 202 (Y1 direction in FIG. 1B). When the support shaft 212 shifts in the direction toward the top surface of the base 202, the punching member 211 pierces holes in the paper sheets that have been inserted into the space 213.

In a fulcrum-shifting hole-piercing punch such as the one described above, the manual force acts on the support shaft 212 via round hole 209 when the handle 207 is pivoted by the user. The support shaft 212 is guided by the support shaft-guiding hole 205 for a reciprocal linear movement in a direction orthogonal to the top surface of the base 202. As a result of the movement (downward) of the support shaft 212 in a direction orthogonal to the top surface of the base 202, the punching member 211 makes a hole-piercing movement into the paper sheets. Then, the support shaft 212 is controlled by the support shaft-guiding hole 205 in a direction that is parallel to the top surface of the base 202 (Z1 direction in FIG. 1B) and is not pivoted with the pivoting of the handle 207.

Furthermore, when the punching member 211 makes the hole-piercing movement into the paper sheets, guided by the pivoting shaft-guiding groove 206 provided in the support platform 204, the pivoting shaft 210 moves in a direction parallel to the top surface of the base 202 (Z1 direction in FIG. 1B) so as to move away from the support shaft 212 (the amount of movement is represented as t).

In general, with a hole-piercing punch, at the moment when the paper sheets begin to be pierced by a hole, the maximum hole-piercing load as the load required for hole piercing (hereinafter, simply referred to as "maximum hole-piercing load") is supposed to be applied. Furthermore, as shown in FIG. 1B, when the maximum hole-piercing load is applied to the fulcrum-shifting punch 200, the distance L2*a*' between the axial centers of the pivoting shaft 210 and the support shaft 212 changes as described below. Specifically, when the maximum hole-piercing load is applied to the fulcrum-shifting punch 200, the support shaft 212 moves from one end of the support shaft-guiding hole 205 to the center, and the pivoting shaft 210 also moves from one end of the support shaft-guiding hole 205 side in the pivoting shaft-guiding groove 206 to the other end. Then, the pivoting shaft 210 moves away from the punching member 211 by an amount equivalent to the amount of movement t. Once the pivoting shaft 210 moves as described when the maximum hole-piercing load is applied to the fulcrum-shifting punch 200, the distance L2*a*' between the fulcrum (pivoting shaft 210) and the action point (support shaft 212) becomes greater in comparison to the distance L2*a* (FIG. 1A) at the time when the punching member 211 begins to descend.

When calculated in terms of the principle of leverage, at a time when the maximum hole-piercing load is applied to the handle 207 of the conventional fulcrum-shifting punch 200, that is, the load to be applied to the tip of the handle 207 is described as below.

Formula 1

$$F1a'=F2a'\times L2a'/L1a' \quad (1)$$

Here,

F1*a*': An acting force to act on the punching member 211 in the downward direction F2*a*': A reacting force as opposed to the acting force F1*a*'

L1*a*': Distance between power point and fulcrum (between one point of the handle 207 and the pivoting shaft 210)

L2*a*': Distance between fulcrum and action point (between the axial centers of the pivoting shaft 210 and the support shaft 212).

As indicated by Formula 1, when the maximum hole-piercing load is applied, the distance L2*a*' between the fulcrum and the action point increases by the amount equivalent to the amount of deviating movement t of the pivoting shaft 210 from the distance L2*a* between the fulcrum and the action point at the time when hole piercing begins. Therefore, the maximum hole-piercing load applied to the fulcrum-shifting punch 200 increases (cf. Japanese patent application laid-open disclosure 2006-198684).

Regarding this point, in the case of a fulcrum-fixed hole-piercing punch, the fulcrum (pivoting shaft) does not deviate from the action point (support shaft). Therefore, a fulcrum-fixed punch may reduce more load applied to the handle at the time when the maximum hole-piercing load is applied in comparison to a conventional fulcrum-shifting punch 200 such as the one shown in FIG. 1A. Next, an outline of a conventional fulcrum-fixed punch is described using FIG. 2.

FIG. 2 shows a schematic side view of a conventional fulcrum-fixed punch 300. FIG. 2A is a lateral view of a conventional fulcrum-shifting punch 200 when a punching member 211 starts descent. FIG. 2B is a schematic side view of a conventional fulcrum-fixed punch 300 to which maximum hole-piercing load is applied. FIG. 2C is a lateral view of a conventional fulcrum-fixed punch 300 when finishing hole-piercing.

As shown in FIG. 2, as in the previously described fulcrum-shifting punch 200, the fulcrum-fixed punch 300 has a support platform 304 fixed onto the top surface of a base 302 by a securing fixture 303. Furthermore, a support shaft-guiding hole 305 is provided at one end of the support platform 304. However, in the fulcrum-fixed punch 300, a securing hole 306 is provided. The securing hole 306 allows a pivoting shaft 310 to be inserted therein and holds the same so as to be pivotable while fixing the position. In other words, the positional relation of the support platform 304 and the pivoting shaft 310 is fixed in the fulcrum-fixed punch 300 (FIG. 2).

Furthermore, in the fulcrum-fixed punch 300, a pivoting shaft-guiding hole 308 is provided at one end of a handle 307. The pivoting shaft 310 is inserted into the pivoting shaft-guiding hole 308 so as to be movable with respect to the handle 307. Moreover, a round hole 309 is provided at one end of the handle 307. A support shaft 312 is inserted into the round hole 309 in a fixed state with respect to the handle 307. In addition, the support shaft 312 is inserted into the round hole 309 and the support shaft-guiding hole 305 of the support platform 304 so as to be parallel to the top surface of the base 302. A punching member 311 extending in the same direction as the support shaft-guiding hole 305 is provided with the support shaft 312.

A user carries out the hole piercing of a sheet material such as paper sheets using a fulcrum-fixed punch 300 as follows. First, as in FIG. 2A, the user inserts paper sheets into the space 313 when the handle 307 (power point) of the fulcrum-fixed punch 300 is in a state of in which no load is applied. Herein, for convenience of explaining the hole-piercing load on the fulcrum-fixed punch 300 to be described later, the center position of the support shaft 312 with respect to the support shaft-guiding hole 305 when the fulcrum-fixed punch 300 is in a state of FIG. 2A is referred to as a (cf. FIG. 3). Likewise, the center position of the pivoting shaft 310 in the pivoting shaft-guiding hole 306 is referred to as c (cf. FIG. 3).

The user inserts paper sheets and then presses down the handle 307 as shown in FIG. 2B. The handle 307 is pivoted by the user's operation with the pivoting shaft 310 acting as the fulcrum. The direction of the handle 307 to be pivoted by the user is the direction in which the tip of the handle 307 approaches the top surface of the base 302 (X2 direction in FIG. 2B).

When the handle 307 is pressed down, the support shaft 312 that has been inserted into the round hole 309 is guided by the support shaft-guiding hole 305 of the support platform 304 and moves in a direction toward the top surface of the base 302 (Y2 direction in FIG. 2B). Accompanied by the movement of the support shaft 312, the tip (blade part) of the punching member 311 moves in the direction toward to the top surface of the base 302 (Y2 direction in FIG. 2B) along with the support shaft 312. Once the tip of the punching member 311 reaches the paper sheets, the punching member 311 starts piercing holes in the paper sheets.

Next, from the state of FIG. 2B, the handle 307 is further pivoted by the user in the X2 direction. Once the handle 307 is pivoted in the X2 direction as shown in FIG. 2C, the punching member 311 descends while being guided by the support shaft-guiding hole 305 (Y2 direction in FIG. 2B). Once the punching member 311 descends, the punching member 311 completes the piercing of holes in the paper sheets inserted into the space 313. The center position of the support shaft 312 in the support shaft-guiding hole 305 then is represented as b (cf. FIG. 3).

When the handle 307 is being pivoted by the user as described above, a manual force acts on the support shaft 312 via the round hole 309. The manual force acts so as to press down the support shaft 312. When the user presses down the support shaft 312, the support shaft 312 is guided into the support shaft-guiding hole 305 and comes down to the top surface side of the base 302 (cf. FIG. 2C). Therefore, the support shaft-guiding hole 305 controls the direction of movement of the support shaft 312. The controlled direction of the support shaft 312 is a direction that is parallel to the top surface of the base 302 and also a direction heading toward the other end from one end of the hole-piercing portion in the base 302 (Z2 direction in FIG. 2C). Thus, even if the handle 307 is pivoted, the support shaft 312 is not pivoted in conjunction with the pivoting operation.

Herein, with reference to FIG. 3, changes in the force acting on the support shaft 312 when the user presses the handle 307 downward is described. FIG. 3 is a schematic enlarged cross-sectional drawing for describing the frictional force received by the support shaft 312 in a conventional fulcrum-fixed punch 300. It should be noted that frictional force refers to a frictional force that acts between the support shaft 312 and the support shaft-guiding hole 305 attributed to pivoting of the handle 307.

First, as shown in FIG. 2 A, when the punching member 311 begins to descend, the center position of the support shaft 312 is located at "a" in FIG. 3. That is, frictional force is hardly present at this moment.

However, once the handle 307 is pressed down in the X2 direction as shown in FIG. 2B, 2C, the support shaft 312 attempts to draw a movement locus arc ad with the pivoting shaft 310 as a fulcrum. The support shaft-guiding hole 305 prevents the pivoting shaft 310 from pivoting (cf. FIG. 3). In other words, the support shaft 312 descends while being subjected to force working in the direction between the direction Z2 deviating from the pivoting shaft 310 and the direction Y2 in which hole piercing is carried out by the punching member 311 (cf. FIG. 2). Consequently, frictional force is received.

As for this conventional fulcrum-fixed punch 300, when hole piercing is finished (cf. FIG. 2C), as shown in the structure in FIG. 3, the center position c of the pivoting shaft 310 and the original position d of the support shaft 312 when the support shaft-guiding hole 305 is not present, become most distant.

Therefore, when the support shaft 312 is descending while unable to draw the original movement locus arc ad, the frictional force received by the support shaft 312 begins to increase from the moment when the punching member 311 begins to descend (FIG. 2A) and reaches a maximum Lmax according to the following formula when hole piercing is finished (FIG. 2C). That is, $$L\max = ac - cb = bd \text{ (cf. FIG. 3)}$$

This increase in frictional force has a risk of causing an increased hole-piercing load on the hole-piercing punch.

Therefore, it is necessary for a hole-piercing punch to be configured to decrease the frictional force generated between the guiding hole of a support shaft and the support shaft and to reduce the effect on the hole-piercing load. For example, some conventional hole-piercing punches have a slot hole as the shape of the hole in the handle. The slot hole is provided for the purpose of directly conveying manual force to the support shaft. This hole-piercing punch is described in FIG. 4.

FIG. 4A-4C show schematic side views and partially enlarged drawings of a conventional hole-piercing punch 400. FIG. 4A shows the time when a punching member 411 begins to descend. FIG. 4B shows the time when the maximum hole-piercing load is applied to the hole-piercing punch. FIG. 4C shows the time when the punching member 411 completes the hole-piercing.

As in the previously described fulcrum-fixed punch 300, a support shaft-guiding hole 405 is provided at one end of a support platform 404 shown in FIG. 4A. Likewise, a securing hole 406 for fixing the position of the pivoting shaft 410 while pivotably holding the pivoting shaft 410 is provided at one end of the support platform 404. Thus, the axial center position of the pivoting shaft 410 in the support platform 404 is fixed.

Furthermore, a round hole 408 and a slot hole 409 with allowance of movement are provided at one end of the base 402 side of the handle 407. Inserted into the round hole 408 and the securing hole 406 of the support platform 404, the pivoting shaft 410 is pivotably attached to the support platform 404. A support shaft 412 is inserted into the slot hole 409 of the handle 407 and the support shaft-guiding hole 405 of the support platform 404 so as to be approximately parallel to the top surface of the base 402. A punching member 411 extending in the same direction as the support shaft-guiding hole 405 is provided with a support shaft 412.

Even with this conventional hole-piercing punch 400, hole piercing is carried out on paper sheets with the same steps as in the previously described fulcrum-fixed punch 300. Furthermore, this hole-piercing punch 400 is configured to permit the slot hole 409 provided in the handle 407 to have the allowance of movement in comparison with the case of the previously described fulcrum-fixed punch 300. With this constitution, in the event of performing hole piercing using a hole-piercing punch 400, the handle 407 is pivoted while moving toward a direction in which the frictional force on the support shaft 412 is decreased. Therefore, in the hole-piercing punch 400, a frictional force that increases between the support shaft-guiding hole 405 and the support shaft 412 when the handle 407 is pivoted, is decreased.

However, in a conventional hole-piercing punch 400 such as the one shown in FIG. 4, during the time from the moment when the punching member 411 in FIG. 4A begins to descend until the moment when the maximum hole-piercing load is applied in FIG. 4B, the force that is applied to the handle 407 (power point) is dispersed while being conveyed to the support shaft 412 through the slot hole 409, which is inefficient. Furthermore, also during the time from the moment when the punching member 411 begins piercing holes in the paper sheets until the moment when the hole piercing is finished, the force applied to the handle 407 is dispersed.

In other words, as shown in FIG. 4A, the force applied to the handle 407 acts on the support shaft 412 through the slot hole 409 in the handle 407 with the pivoting shaft 410 as the fulcrum. Then, as shown in the partially enlarged drawing in FIG. 4A, the straight-line portion of the slot hole 409 comes in contact with the support shaft-guiding hole 405 in an inclined manner with respect to the support shaft 412. Therefore, the acting manual force through the slot hole 409 works in the F1 direction. However, the manual force acting in the F1 direction is controlled by the support shaft-guiding hole 405. Consequently, the manual force acting in the F1 direction splits into the F1*y* direction, which is parallel to the punching member 411, and the orthogonal crossing F1*x* direction.

Similarly, during the time from the moment when the straight-line portion of the slot hole 409 orthogonal crosses the support shaft-guiding hole 405 (FIG. 4C) until the moment when hole piercing is finished, as shown in the partially enlarged drawing in FIG. 4C, the straight-line portion of the slot hole 409 comes in contact with the support shaft-guiding hole 405 in an inclined manner with respect to the support shaft 412. Therefore, the force applied to the handle 407 acts in the F3 direction through the slot hole 409 and is controlled by the support shaft-guiding hole 405. Thus, the force applied to the handle 407 splits into the F3*y* direction, which is parallel to the punching member 411, and the orthogonal crossing F3*x* direction.

On the other hand, in a conventional fulcrum-fixed punch, because a hole on the handle side that holds the support shaft is fixed, there is no means for decreasing the frictional force, so there is the risk that the hole-piercing load may be increased by receiving the frictional force as described above. Furthermore, a support-shifting punch as in patent application laid-open disclosure 2006-198684 disadvantageously allows the fulcrum and action point to diverge so as to be separate, thus resulting in a greater maximum hole-piercing load.

SUMMARY OF THE INVENTION

With respect to the abovementioned disadvantage, the present invention is directed at providing technology in a hole-piercing punch for efficiently conveying force to a punching member while reducing the frictional force, and thereby reducing the hole-piercing load.

An aspect of the present invention is a hole-piercing punch for piercing holes in paper sheets, provided with a base platform, a support platform mounted uprightly from one surface of the base platform, and a handle member that is pivotably supported by the support platform, comprising: a pivoting shaft of said handle member in which the axial center position in the support platform is approximately fixed by being inserted into a shaft hole formed in said support platform, a slot hole that is formed at one end of said handle member and has allowance of movement, into which said pivoting shaft is inserted so as to make the position of the handle member displaceable with respect to the pivoting shaft, a support shaft-guiding hole that is formed at the position of the tip of said handle member from said shaft hole of said support platform and has a longitudinal direction in a direction that is orthogonal to one surface of said base platform, a support shaft that has a position fixed in said handle member by being inserted into a support hole formed in the handle member near said pivoting shaft and at the same time near a line connecting the tip and the pivoting shaft of said handle member, and is guided into said support shaft-guiding hole to be pressed down via the support hole as a result of pressing down the handle, and a punch member that has a blade part at one end of one surface of said base platform and moves along with the support shaft while being held by the support shaft so as to be orthogonal to said support shaft, wherein the axial center of said pivoting shaft is positioned near a perpendicular bisector of a segment connecting both ends of said support shaft-guiding hole.

Another aspect of the present invention is a hole-piercing punch comprising: a support platform is mounted uprightly by being fixed to one surface of a base platform, a shaft hole provided at a position away from said one surface in said support platform so as to be substantially parallel to said one surface, a support shaft-guiding hole provided near said shaft hole in said support platform and extending in a direction substantially orthogonal to one surface of said base platform, a support shaft inserted into a support shaft-guiding hole so as to be substantially parallel to one surface of said base platform, a punching member of a column shape, wherein one end thereof has a blade part, while the other end is fixed to said support shaft so that the longitudinal direction of the blade part is orthogonal to one surface of said base platform, a pivoting shaft for which the axial center position thereof with respect to said support platform is fixed while being supported by being inserted into a shaft hole so as to be substantially parallel to one surface of said base platform, and a handle member that has its pivoting shaft inserted into one end thereof, has a slot hole having allowance of movement and a support hole for fixing and supporting the axial center position of said support shaft near the slot hole, and has been made pivotable with said pivoting shaft as a fulcrum and, wherein the position of said pivoting shaft is to be situated so that a triangle is formed as a nearly isosceles triangle with the axial center position of the pivoting shaft as a vertex and said support shaft-guiding hole as a base platform.

Regarding the hole-piercing punch according to the present invention described above, a slot hole provided in a handling member, into which the pivoting shaft of a handle member is inserted, has allowance of movement. Further, the axial center position of the support shaft is fixed with respect to the handle member. Therefore, while displacing the position of the handle member with respect to the pivoting shaft via the slot hole to control the frictional force, the force to be conveyed to the support shaft via a support hole from the handle member is efficiently conveyed.

Furthermore, regarding the hole-piercing punch according to the present invention, the pivoting shaft of the handle member is pivotably inserted into a shaft hole so that the axial center position thereof is displaced very little with respect to the support platform. Moreover, the handle member has a slot hole that has greater allowance of movement than the diameter of the shaft hole and has a support hole near the slot hole, which has a diameter that is slightly larger than said support shaft.

In other words, the support hole into which the support shaft is to be inserted in the handle member is formed so as to support the axial center position of the support shaft by fixing the same. Therefore, the hole-piercing punch according to the present invention makes it possible to efficiently convey a manual force applied to the handle member to the support shaft. Furthermore, because the slot hole into which the pivoting shaft is inserted has allowance of movement, the hole-piercing punch according to the present invention suppresses the unnecessary force in the direction orthogonal to the hole-piercing direction.

Moreover, the axial center of the pivoting shaft of the hole-piercing punch according to the present invention is formed so as to be located in the vicinity on a perpendicular bisector of a segment connecting both ends of a support shaft-guiding hole. Alternatively, the same is constituted so that a triangle with the axial center position of the pivoting shaft 110 of the hole-piercing punch as a vertex and the support shaft-guiding hole 105 as a base nearly forms an isosceles triangle. Therefore, the maximum amount of displacement of the axial center position of the support shaft in a direction that is orthogonal to the hole-piercing direction may be decreased, and frictional force generated between the support shaft and the support shaft-guiding hole may be decreased. Moreover, because the pivoting shaft and the support shaft approach each other at or around the hole-piercing starting point, the force acting on the punching member may be increased.

Furthermore, according to the constitution above, frictional force between the support shaft and the support shaft-guiding hole is absorbed by the slot hole for linear movement of the support shaft, so the length of the slot hole may thus be made shortest. Due to the constitution of the hole-piercing punch, the efficiency of conveying the force when the handle member is pivoted, is improved. In other words, although the efficiency of energy conveyance is degraded because of the allowance of movement caused by the long slot hole, it becomes possible to suppress the degradation of energy conveyance efficiency to a minimum. Thus, it allows the hole-piercing punch according to the present invention to reduce the bole-piercing load.

DETAILED DESCRIPTION OF THE EMBODIMENTS

Entire Constitution

Figure 1A:
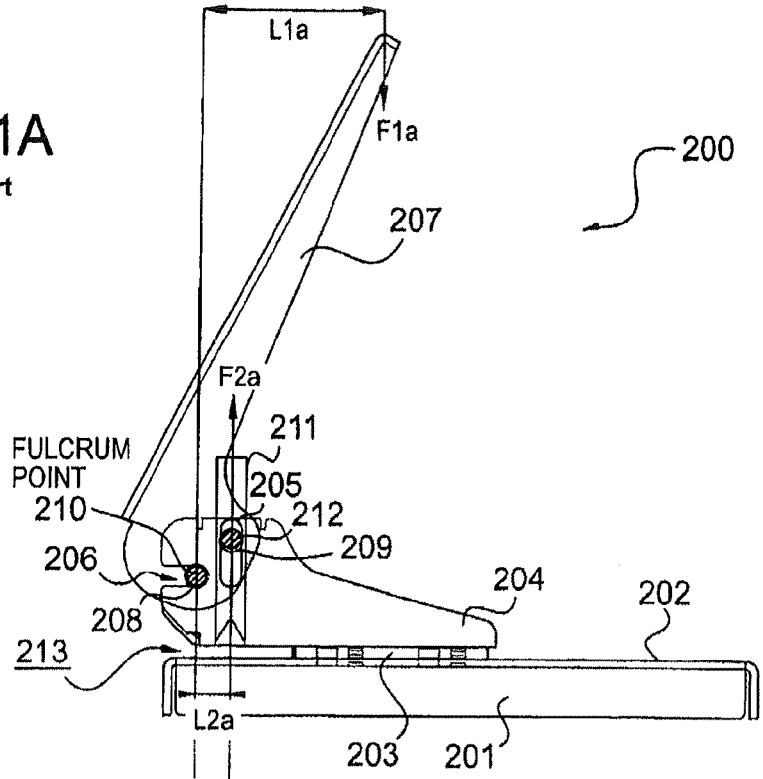
FIG. 1A Prior Art
FIG. 1A is a lateral view of a punching member 211 that works to a conventional fulcrum-shifting punch 200 when starting descent.
Figure 1B:
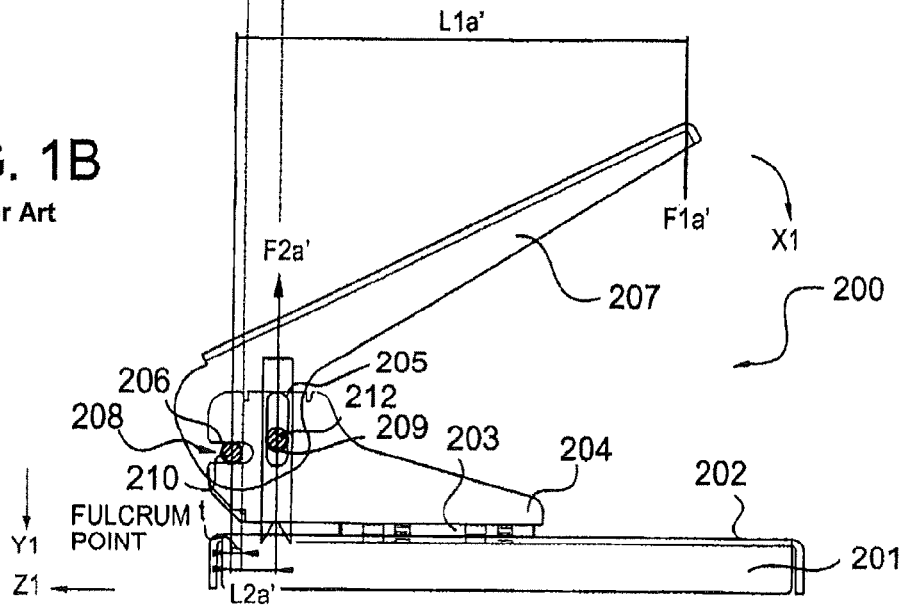
FIG. 1B Prior Art
FIG. 1B is a lateral view of a conventional fulcrum-shifting punch 200 when finishing hole-piercing.
Figure 2A:
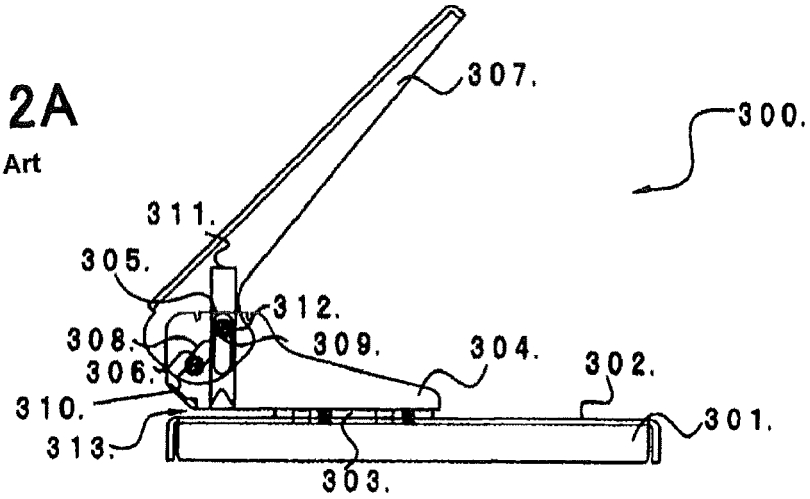
FIG. 2A Prior Art
FIG. 2A is a lateral view of a punching member 311 that works to a conventional fulcrum-fixed punch 300 when starting descent.
Figure 2B:
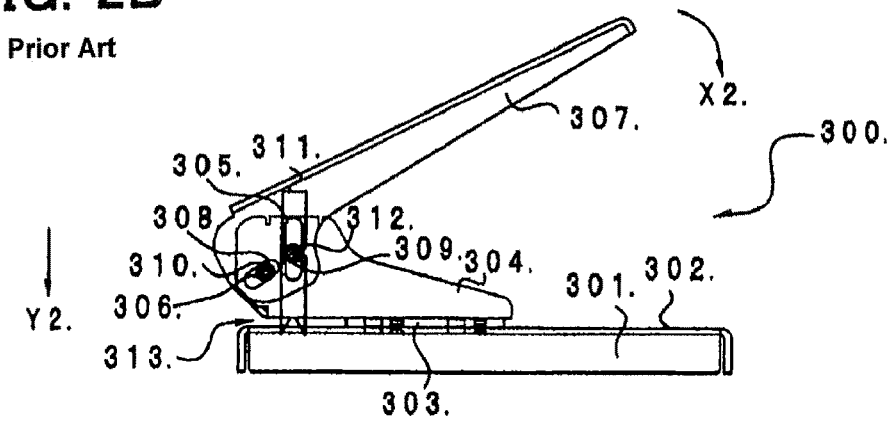
FIG. 2B Prior Art
FIG. 2B is a schematic side view of a conventional fulcrum-fixed punch 300 to which maximum hole-piercing load is applied.
Figure 2C:
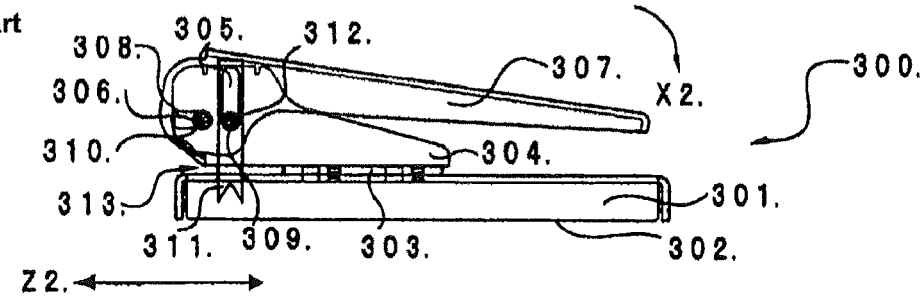
FIG. 2C Prior Art
FIG. 2C is a lateral view of a conventional fulcrum-fixed punch 300 when finishing hole-piercing.
Figure 5:
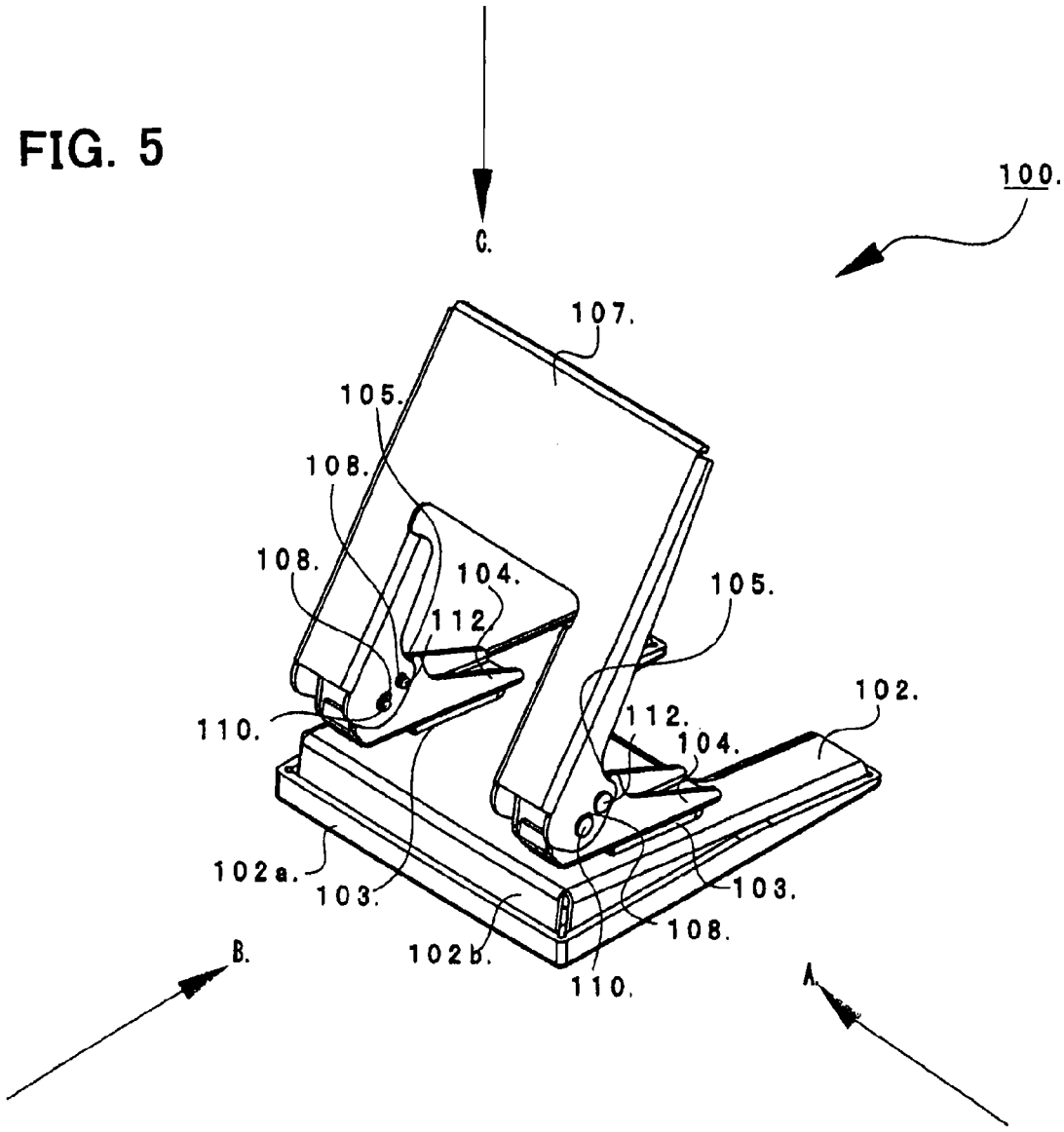
FIG. 5 is a schematic perspective view showing the appearance of the hole-piercing punch related to an embodiment according to the present invention.
Figure 6A:
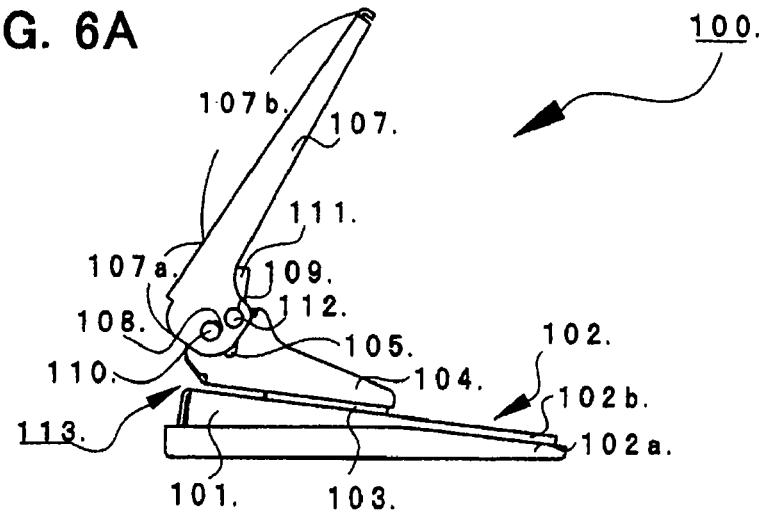
FIG. 6A is a schematic right side view of the hole-piercing punch related to the embodiment according to the present invention.
Figure 6B:
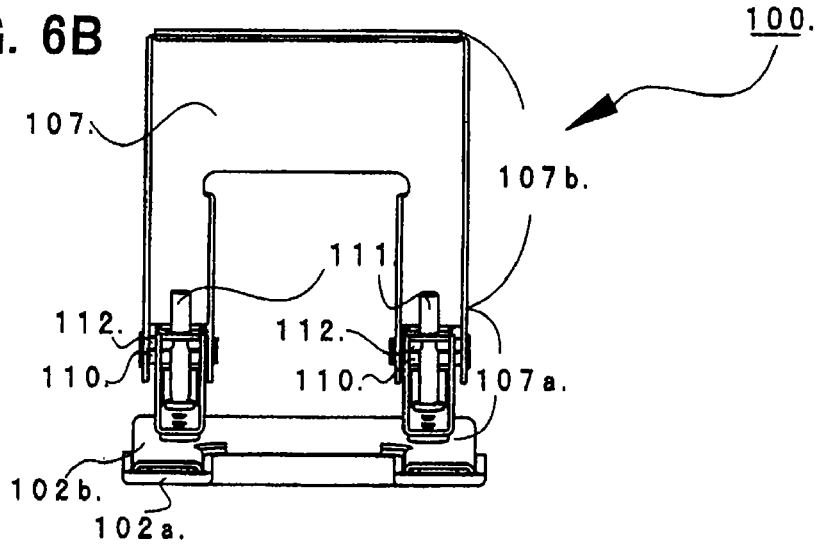
FIG. 6B is a schematic rear view of the hole-piercing punch related to the embodiment according to the present invention.
Figure 6C:
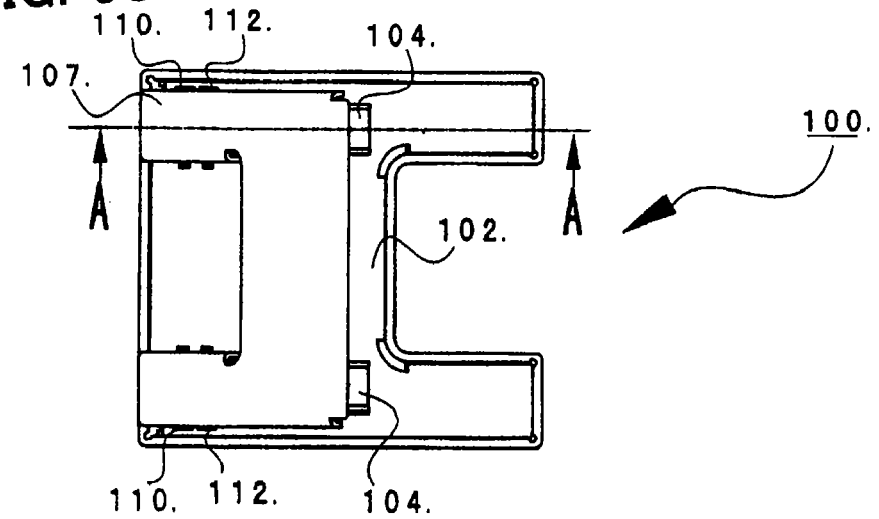
FIG. 6C is a schematic top view of the hole-piercing punch related to the embodiment according to the present invention.
Figure 7A:
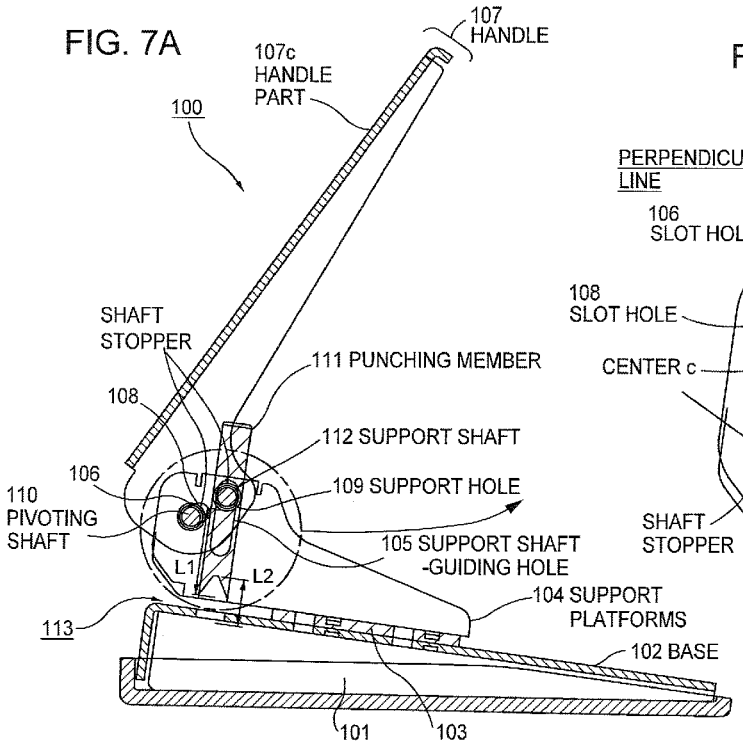
FIG. 7A is a schematic A-A cross sectional drawing of the hole-piercing punch related to the embodiment according to the present invention in FIG. 6C.
Figure 7B:
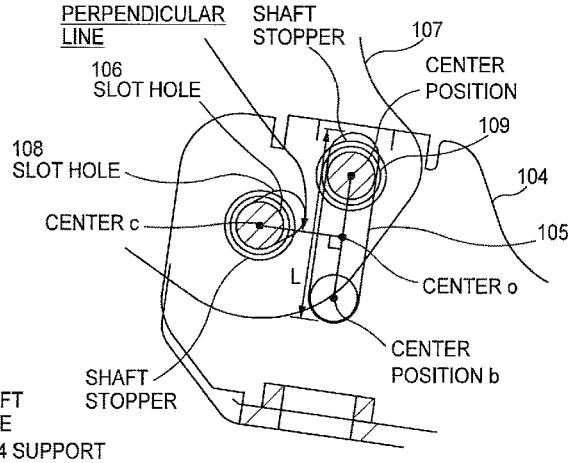
FIG. 7B is a partially enlarged drawing of FIG. 7A.

Regarding the constitution of a hole-piercing punch related to the embodiment according to the present invention, the outline is described with reference to FIG. 5 to FIG. 7. FIG. 5 is a schematic perspective view showing the appearance of the hole-piercing punch 100 related to the embodiment according to the present invention. FIG. 6A is a schematic right side view when the hole-piercing punch 100 related to the embodiment according to the present invention is seen from the A direction in FIG. 1. FIG. 6B is a schematic rear view when the hole-piercing punch 100 related to the embodiment according to the present invention is seen from the B direction in FIG. 1. FIG. 6C is a schematic top view when the hole-piercing punch 100 related to the embodiment according to the present invention is seen from the C direction in FIG. 1. FIG. 7A is a cross-sectional drawing of A-A of FIG. 6C showing a schematic top view of the hole-piercing punch 100 related to the embodiment according to the present invention, and FIG. 7B is a partial enlarged drawing of FIG. 7A.

As shown in FIG. 5 the hole-piercing punch 100 related to the present embodiment is equipped with a base 102 (equivalent to an example of the "base platform" according to the present invention). The base 102 is substantially square-shaped and one portion of one side thereof is notched so as to be in a concave shape. When a user places the hole-piercing punch 100 for use, the user places one surface of the base 102 as a bottom face.

The base 102 comprises the bottom cover 102*a* of the bottom surface, which is formed as a plane and the top cover 102*b* of the top surface, which is likewise formed as a plane. The top cover 102*b* has approximately the same rim as the bottom cover 102*a* and is formed slightly smaller than the bottom cover 102*a*. The top cover 102*b* engages with the bottom cover 102*a* in a facing manner. The base is formed by engaging and combining the top cover 102*b* and the bottom cover 102*a*. Furthermore, the inside portion of the base 102 is hollow and acts as a waste storage part 101 for storing chads from the piercing of hole such as in paper sheets subjected to hole-piercing by the hole-piercing punch 100.

As shown in FIG. 5 and FIG. 6A, as for the base 102 in the hole-piercing punch 100, the peripheral part side (hereinafter referred to as the "front side") that has been notched in the top cover 102*b* is formed low. The base 102 is formed so as to be gradually increasing in height from the front side toward the opposite peripheral part side (hereinafter referred to as the "back side"). In other words, the top surface of the top cover 102*b* is formed so as to incline from the front side toward the back side with respect to the bottom surface of the bottom cover 102*a*.

As described above, by inclining the top cover 102*b*, the angle formed by the handle 107 and the base 102 may be decreased. By decreasing the angle, the operability is enhanced in the hole-piercing work with the hole-piercing punch 100. Furthermore, if the inclining angle of the top cover 102*b* is formed at approx. 5°-15°, in most of the steps in which the user presses down the handle 107 (hole-piercing process), it becomes possible to reduce the hole-piercing load. From the perspective of reducing the hole-piercing load, it is more preferably desirable to have an inclination of 7° as the angle of inclination of the top surface of the base 102.

Furthermore, as shown in FIG. 5 and FIG. 6A, 6B, a pair of supporting platforms 104 is mounted upright via a pair of securing fixtures 103 on both side parts of the top surface of the base 102, and the pair of support platforms 104 is mounted parallel to each other and also substantially orthogonal to the top surface of the base 102. Moreover, the support platforms 104 support the handle 107 so as to be pivotable via a pivoting shaft 110 to be described next. Furthermore, the support platforms 104 support the punching member 111 so as to be reciprocable via the support shaft 112 (horizontal shaft). It should be noted that the pair of support platforms 104 are equivalent to an example of "a first support column" and "a second support column" according to the present invention.

In other words, as shown in FIG. 6A, 6B, a pair of pivoting shaft 110 (rotary shaft) is inserted into each support platforms 104 at one end of the back side of the base 102. The direction of insertion of the pivoting shaft 110 is a direction that is orthogonal to the uprightly mounted direction of the support platforms 104 and also a direction that is parallel to the top surface of the base 102. Furthermore, the pivoting shaft 110 is also inserted into the handle 107 and is rotatable with respect to both the support platforms 104 and the handle 107. Shaft stoppers are formed on both ends of the pivoting shaft 110 (cf. FIG. 7). The shaft stoppers are for preventing the pivoting shaft 110 from slipping off the support platforms 104 and the handle 107, and have a diameter that is larger than the diameter of the pivoting shaft 110 or the shaft hole 106 to be described later and the width of the slot hole 108.

Moreover, as shown in FIG. 6A, in the vicinity of the pivoting shaft 110 in the support platforms 104, a support shaft 112 is inserted. The position at which the support shaft 112 is to be inserted is slightly toward the front side from the position at which the pivoting shaft 110 is inserted. Also, the direction for the support shaft 112 to be inserted into the support platforms 104 is a direction that is orthogonal to the uprightly mounted direction of the support platforms 104 and also a direction that is parallel to the top surface of the base 102.

As shown in FIG. 7A, the support shaft 112 is inserted so as to be guided by a support shaft-guiding hole 105 provided in the support platforms 104. Furthermore, the support shaft 112 is inserted with the axial center position thereof fixed with respect to the handle 107. Moreover, shaft stoppers are formed on both ends of the support shaft 112. The shaft stoppers are for preventing the support shaft 112 from slipping off the support platforms 104 and the handle 107, and have a diameter that is larger than the diameter of the support shaft 112 or the support hole 109 and the width of the support shaft-guiding hole 105 (cf. FIG. 7). In addition, the support shaft-guiding hole 105 is equivalent to an example of the "guiding groove" according to the present invention.

Furthermore, as shown in FIG. 6B, the support shaft 112 is inserted so as to be substantially parallel to the top surface of the base 102. Moreover, the support shaft 112 is inserted into the punching member 111. Because the support shaft 112 is inserted into the punching member 111, the support shaft 112 holds the punching member 111 so that the punching member 111 extends in a direction that is substantially orthogonal to the top surface of the base 102.

As described above, the handle 107 is held by a pair of support platforms 104 with the pivoting shaft 110 as a pivoting center. As shown in FIG. 6B, the handle 107 is equipped with a connection part 107*a* as a portion to be connected to the support platforms 104. The connection part 107*a* is provided in a position corresponding to the end part of the support platforms 104 in the handle 107. Furthermore, the connection part 107*a* is constituted of a pair of flat plates disposed in a facing manner leaving an interval that is slightly larger than the width of the support platforms 104. The connection part 107*a* is provided between the flat plates so as to sandwich the support platform 104. The connection part 107*a* is equipped with a slot hole 108 on both flat plates at one end of the back side to face each other. The slot hole 108 is for an insertion of the pivoting shaft 110 inserted into the support platforms 104. Moreover, the handle 107 is equivalent to one example of "handle member" according to the present invention.

Furthermore, as shown in FIG. 7, the connection part 107*a* of the handle 107 is equipped with a support hole 109 in a position near the slot hole 108 and slightly closer to the front side from the slot hole 108. The position for forming the support hole 109 is a position that corresponds to the support shaft 112 inserted into the support platforms 104. Moreover, the support hole 109 is for insertion of the support shaft 112 to prevent it from moving with respect to the handle 107, and is formed in a substantially circular shape having a diameter that is slightly larger than the support shaft 112.

Furthermore, an arm part 107*b* that is uniformly formed with a pair of connection parts 107*a* on the right and the left, is provided with the handle 107. The arm part 107*b* is provided from the bordering portion with the connection part 107*a* so as to be apart from the base 102. The inclining degree of the handle 107 with respect to the base 102 is set optionally so that it is easy for the user to operate the handle 107. For example, as shown in FIG. 6A, when the hole-piercing punch 100 is seen from the side, the support platforms 104 and the handle 107 are connected so that the angle formed by the top surface of the base 102 and a line connecting from the connection part 107*a* to the arm part 107*b* becomes an acute angle.

As described above, by the insertion of the support shaft 112, the punching member 111 is guided by the support shaft-guiding hole 105 via the support shaft 112 so as to be supported vertically movable upward and downward. For the punching member 111, a spring member having a diameter that is slightly larger than the punching member 111 is provided in the outer periphery thereof. One end of the spring member is orthogonal in contact with the support shaft 112. The other end opposite the one end of the spring member is in contact with the top surface of the base 102. The spring member is biased to prevent the punching member 111 from descending before the user presses down the handle 107. When the user presses down the handle 107, a manual force is conveyed to the spring member from the support shaft 112 via the support hole 109 of the handle 107. And when the manual force is conveyed to the spring member, the spring member is contracted resisting the biasing force of the spring member. Once the spring member is contracted, the support shaft 112 comes down.

Furthermore, as shown in FIG. 6A, from one end of the back side of the securing fixtures 103 to the end rim of the back side of the top surface of the base 102, a paper sheets-inserting inlet 113 surrounded by the support platforms 104, the securing fixture 103, and the base 102 is formed in an interval. When the user conducts hole piercing to paper sheets using the hole-piercing punch 100, the user inserts a single or a plurality of paper sheets into the paper sheets-inserting inlet 113. Thereafter, the user performs the hole piercing while keeping the paper sheets in the paper sheets-inserting inlet 113.

Figure 3:
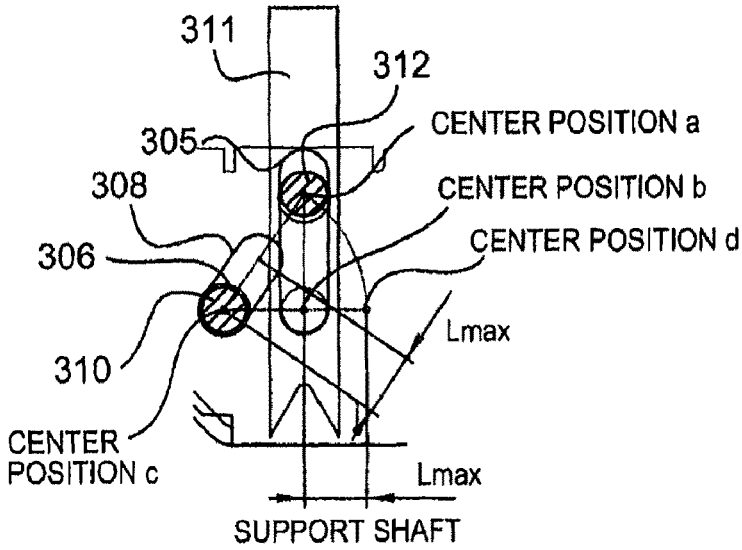
FIG. 3 Prior Art
FIG. 3 is a schematic enlarged cross-sectional drawing for explaining the frictional force received by a support shaft in a conventional fulcrum-fixed punch.
Figure 3:
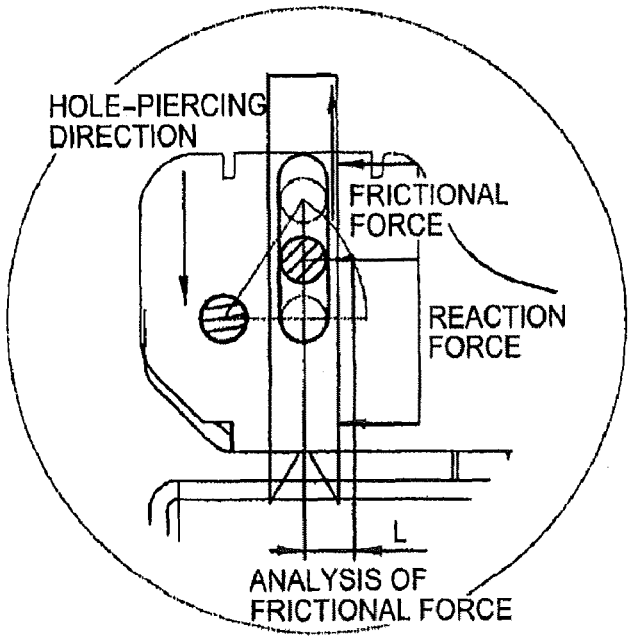
FIG. 3 Prior Art

When the user presses down the handle 107 to cause the punching member 111 to descend, the punching member 111 passes through the paper sheets-inserting inlet 113 and further passes through a punch hole (cf. FIG. 3A) that has been formed at a position corresponding to the punching member 111 in the top surface of the base 102. And when the user presses down the handle 107 further, the punching member 111 displaces to the waste storage 101 from the punched hole. The waste storage 101 is a space surrounded by the top cover 102*b* and the bottom cover 102*a*, for storing hole-pierced wastes of the paper sheets subjected to hole-piercing. Moreover, the punch hole is formed in a diameter with a size allowing the punching member 111 to be inserted, and in a size that allows the hole-pierced wastes to be stored with assurance.

Furthermore, the hole-piercing punch 100 according to the present embodiment may be used by placing it or be used by carrying by hand. Moreover, the hole-piercing punch according to the present invention does not necessarily be a placement type that is presumed to be used by placing the same, but may also be, for example, a hand-carrying type.

Constitution of Support Platform

Figure 8A:
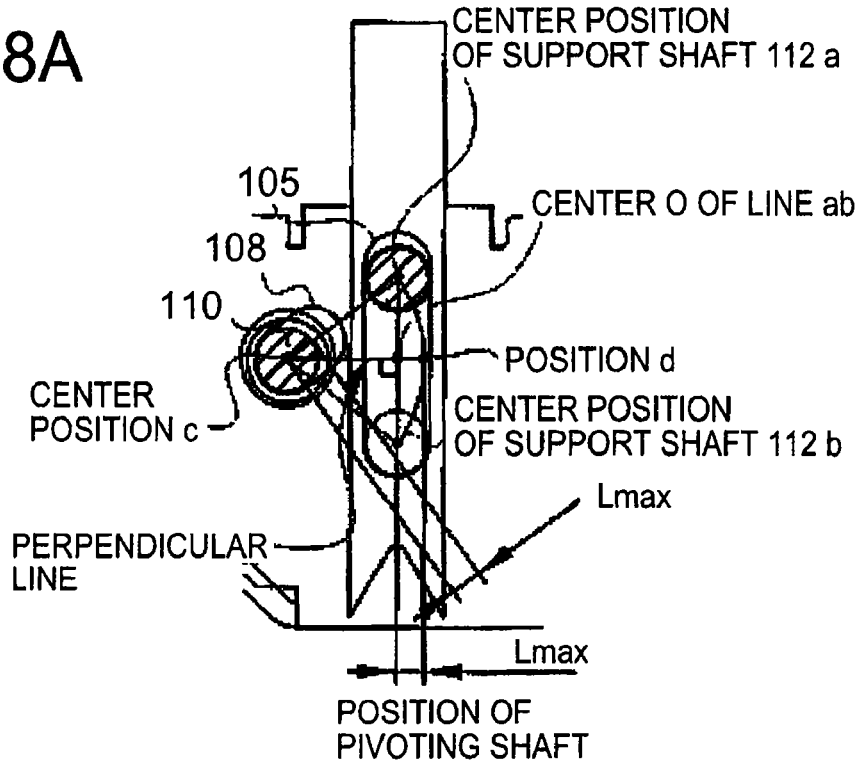
FIG. 8 is a partially enlarged drawing showing the path of reciprocal movement of the support shaft at the support shaft-guiding hole of the hole-piercing punch related to the embodiment according to the present invention.
Figure 8B:
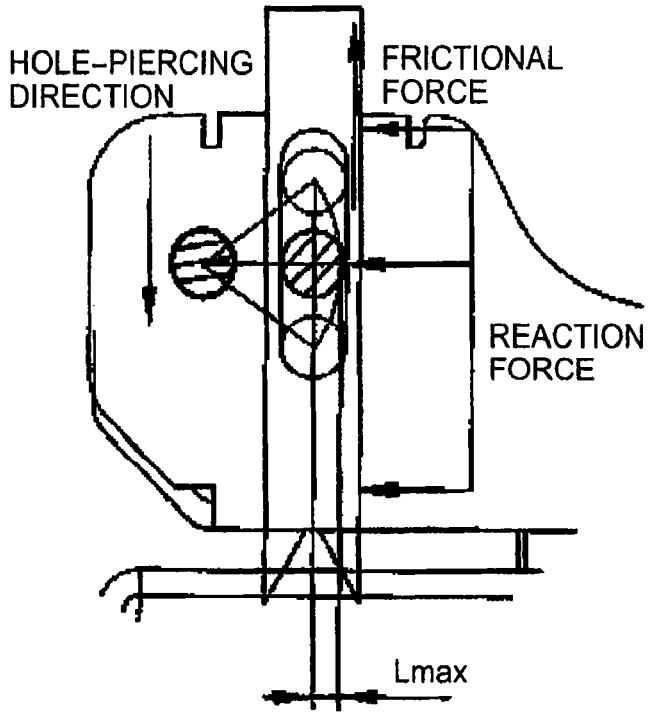

Next, the structure of the connection part with the handle 107 in the support platform 104 is described into the details using FIG. 7 and FIG. 8. Herein, FIGS. 8A and 8B are a partial enlarged drawing showing a reciprocal movement path of the support shaft 112 in the support shaft-guiding hole 105 of the hole-piercing punch 100 related to the present embodiment.

As shown in FIG. 7A, the support shaft-guiding hole 105 is formed on the back side of the support platforms 104. Furthermore, the support shaft-guiding hole 105 is in a shape of a linear long hole having its longitudinal direction that is orthogonal to the top surface of the base 102, and the both ends thereof are in a shape of a circular arc (semicircle). Moreover, the width of the support shaft-guiding hole 105 is formed slightly larger than the diameter of the support shaft 112 so that the support shaft 112 is inserted to be reciprocally movable.

Furthermore, the length of the support shaft-guiding hole 105 determines the maximum movable range of the support shaft 112 and the punching member 111. That is, the upper end of the support shaft-guiding hole 105 is formed in a position where the lower end of the punching member 111 does not block the paper sheets-inserting inlet 113, when the support shaft 112 is at the upper end. Therefore, when the support shaft 112 is at the upper end of the support shaft-guiding hole 105, paper sheets may be inserted into the paper sheets-inserting inlet 113. Moreover, the lower end of the support shaft-guiding hole 105 is formed in a position where a blade of the punching member 111 reaches the waste storage part 101, when the punching member 111 is at the lower end. Therefore, when the support shaft 112 is at the lower end of the support shaft-guiding hole, the punching member 111 penetrates all of the set paper sheets and completes the hole piercing.

That is, as shown in FIG. 7A, before the punching member 111 begins to descend, the support shaft-guiding hole 105 determines the position of the support shaft 112 so that the position of the lower end of the punching member 111 is at least higher than the upper end of the paper sheets-inserting inlet 113.

On the other hand, as the moving distance of the punching member 111 becomes greater until coming to contact with the top surface of the paper sheets that have been inserted into the paper sheets-inserting inlet 113 before beginning to descend, the user has to apply an excessive manual force to the handle 107 for that portion. Therefore, the support shaft 112 needs to be formed so that the lower end of the punching member 111 prior to the start of descending does not come too far apart from the upper end of the paper sheets-inserting inlet 113. Before the punching member 111 begins to descend, the support shaft 112 is biased by the spring member 111*a*. That is, the support shaft 112 is in contact with the upper end of the support shaft-guiding hole 105 (the farthest end part from the top surface of the base 102), and is positioned at the upper end thereof.

Therefore, as shown in FIG. 7A, the upper end of the support shaft-guiding hole 105 is formed in a position that is at least away from the lower end of the support platforms 104 (upper end of the paper sheets-inserting inlet 113) by a distance. The distance is obtained by adding the diameter of the support shaft 112 to a distance L1 between the support shaft 112 and the lower end of the punching member 111.

Furthermore, for a user to certainly conduct the hole-piercing to the paper sheets set by the hole-piercing punch 100, the blade part of the punching member 111 needs to penetrate the paper sheets. Therefore, when the punching member 111 is descended the farthest, it is necessary to determine the position of the support shaft 112 for supporting the punching member 111 so as to allow the blade part thereof to penetrate all of the paper sheets.

The position at the time when the punching member 111 finishes descending, that is, the time when the hole piercing is complete, is defined by the position of the lower end part (end part that approaches the top surface of the base 102) of the support shaft-guiding hole 105 for controlling the movable range of the support shaft 112. Furthermore, to ensure the execution of the hole-piercing, at the time when the hole piercing is complete, it is ideal to define the lower end position of the axial center of the support shaft 112 so that at least the most of the blade part of the punching member 111 is housed in the waste storage part 101. Therefore, the support shaft-guiding hole 105 is formed so that the lower end position of the support shaft-guiding hole 105 comes to a position that is away from the upper end position of the support shaft-guiding hole 105 by a distance. The distance is obtained by adding the diameter of the support shaft 112 to a distance L2 between the upper end of the blade part of the punching member 111 and the waste storage part 101 and (cf. FIG. 7A).

Next, the position of the shaft hole 106 and the pivoting shaft 110 to be inserted into the shaft hole 106 in the support platforms 104 of the hole-piercing punch 100 according to the present embodiment is described. The pivoting shaft 110 is to be the center (fulcrum) when the handle 107 is pivoted.

The shaft hole 106 is for supporting the pivoting shaft 110 in the support platform 104. As shown in FIG. 7A, the shaft hole 106 is formed substantially in a circular shape. Furthermore, the diameter of the shaft hole 106 is formed slightly larger than the diameter of the pivoting shaft 110 so that the pivoting shaft 110 is rotatable and also the axial center position thereof is hardly displaced with respect to the support platforms 104. Moreover, the pivoting shaft 110 is held onto the support platforms 104 by the shaft hole 106. It is to be noted that the reason for constituting the pivoting shaft 110 so as to be rotatable within the shaft hole 106 is to pivot the handle 107 smoothly with respect to the support platforms 104. Moreover, it is also possible to fix the pivoting shaft 110 at the position of the shaft hole 106 (in this case, the shaft hole 106 is no longer required).

Furthermore, the position of the shaft hole 106 is further to the back side from the support shaft-guiding hole 105 in the support platforms 104, and also is formed on the perpendicular bisector of a segment connecting the upper and the lower end of the support shaft-guiding hole 105 in the longitudinal direction. That is, the position of the shaft hole 106 is determined with the upper end and the lower end of the support shaft-guiding hole 105 as the base and the shaft hole 106 as the vertex so as to form a nearly isosceles triangle (FIG. 7B).

Moreover, as shown in FIG. 7B, the preferable position of the shaft hole 106 is a position where the shortest distance between the shaft hole 106 and the support shaft-guiding hole 105 becomes shorter than the length in the longitudinal direction of the support shaft-guiding hole 105 (from the upper end to the lower end).

By forming as above, when the support shaft 112 is positioned in the intermediate position in the support shaft-guiding hole 105, as shown in FIG. 8B, the pivoting shaft 110 and the support shaft 112 approach each other.

The intermediate position means a position that is in the middle of the upper end position of the support shaft 112 when the punching member 111 is the farthest from the top surface of the base 102 (FIG. 8A) and the lower end position of the support shaft 112 when the hole piercing is completed by the punching member 111. Also, in the hole-piercing punch 100 according to the present embodiment, when the blade part of the punching member 111 comes to contact with paper sheets and starts hole-piercing, that is, when the maximum hole-piercing load is applied to the punching member 111, by the constitution, the support shaft 112 is to be positioned at the intermediate point of the support shaft-guiding hole 105 or adjacent thereto.

Such a constitution makes the moment when the maximum hole-piercing load is applied and the moment when the pivoting shaft 110 as a fulcrum and the support shaft 112 as an action point approach each other nearly the same. Therefore, it becomes possible to cause a manual force applied to the handle 107 as a power point to more significantly act on the action point, thus, making the energy saving in a hole-piercing work possible. By the constitution, the hole-piercing punch 100 according to the present embodiment 100 has following characteristics.

With the hole-piercing punch 100, when the handle 107 is pivoted to the maximum limit, the support shaft 112 moves from the center position "a" to the center position "b" in FIG. 8A. Furthermore, as described above, the pivoting shaft 110 is on the perpendicular bisector of the support shaft-guiding hole 105 (cf. FIG. 8). Therefore, accompanied by the movement of the center position of the support shaft 112 from "a" to "b", the slot hole 108 provided on the handle 107 side absorbs the attempt of circular arc movement by the support shaft 112 by an equivalent of the length:

$$Lmax=cd-co=od$$

The amount of movement of the center position of the support shaft 112 that is absorbed by the slot hole 108 is an equivalent of $$Lmax=od$$

Due to the action of the slot hole 108, the support shaft 112 makes a linear movement from the center position "a"→position "o"→center position "b".

As described, because the pivoting shaft 110 is at the vertex of the isosceles triangle with the support shaft-guiding hole 105 as the base, as a result, the length Lmax becomes the shortest distance od. Therefore, a frictional force that is generated at the time of linear movement of the support shaft 112 may be minimized.

As described above, since the shaft hole 106 is formed on the perpendicular bisector of the support shaft-guiding hole 105, the maximum displacement Lmax=od of the support shaft 112 absorbed by the slot hole 108 can be reduced. By that portion, efficiency of the conveyance of a force when the handle 107 is rotated, is improved. That is, allowance of movement is generated by an amount equivalent to the longer portion of the slot hole 108, thus degrading the efficiency of energy transfer, which may be suppressed to a minimum.

Furthermore, because the pivoting shaft 110 acting as the pivoting center position of the handle 107 is fixed to the support platforms 104 and an action force by pivoting of the handle 107 is conveyed directly without having any allowance of movement between the support shaft 112 and the handle 107, there is better efficiency.

Constitution of the Handle

Figure 9A:
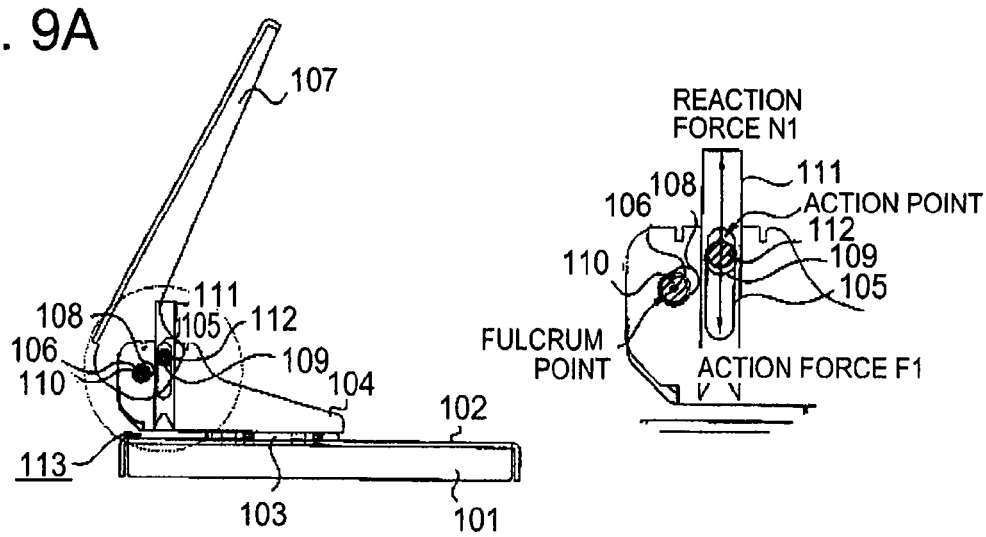
FIG. 9A is a side view and a partially enlarged drawing showing the hole-piercing punch when the punching member related to the embodiment according to the present invention begins to descend.
Figure 9B:
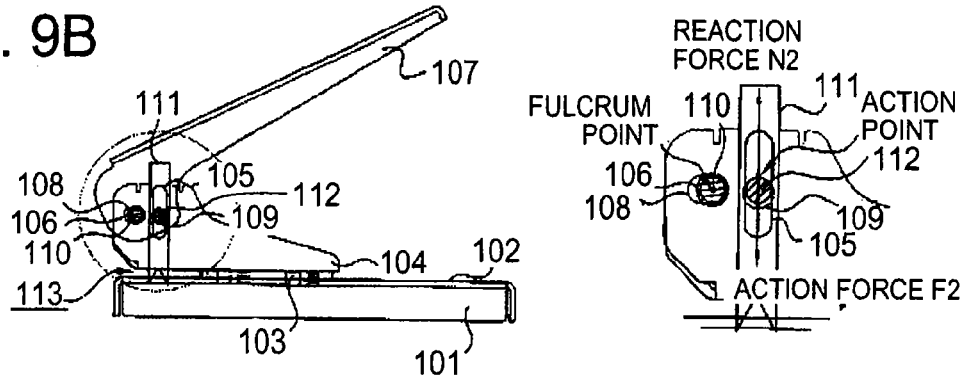
FIG. 9B is a side view and a partially enlarged drawing showing a state in which the hole-piercing punch related to the embodiment according to the present invention receives the maximum hole-piercing load.
Figure 9C:
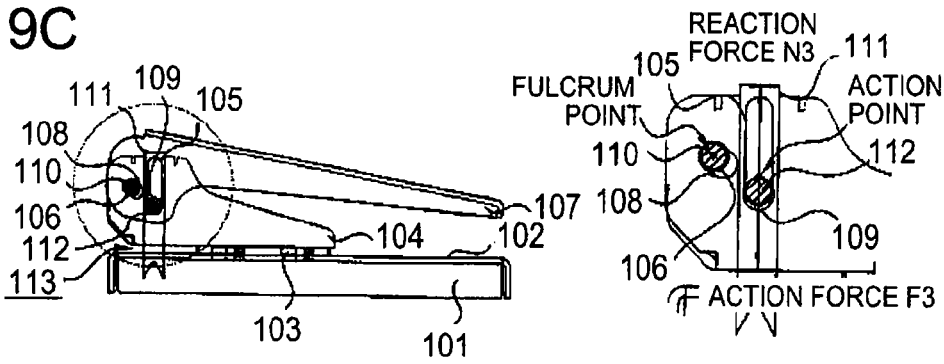
FIG. 9C is a schematic side view and a partially enlarged drawing showing the state of the hole-piercing punch related to the embodiment according to the present invention when hole piercing is finished.

Next, the structure of a connection portion with the support platforms 104 in the handle 107 is described into the details using FIG. 9. Herein, FIG. 9A is a side view and a partial enlarged drawing showing the hole-piercing punch 100 related to the present embodiment when the punching member 111 started descending. FIG. 9B is a side view and a partial enlarged drawing showing a state in which the hole-piercing punch 100 related to the present embodiment receives the maximum hole-piercing load. And FIG. 9C is a schematic side view and a partial enlarged drawing showing a state of the moment when the hole piercing is finished by the hole-piercing punch 100 related to the present embodiment.

As described in FIG. 9A, the handle 107 has its pivoting shaft 110 inserted into the slot hole 108 of the connection part 107*a*. And the handle 107 has its support shaft 112 inserted into the support hole 109 of the connection part 107*a*. By this constitution, the handle 107 is connected to the support platforms 104.

Furthermore, as shown in FIG. 9A, the slot hole 108 of the connection part 107*a* of the handle 107 is formed at a position corresponding to the shaft hole 106 of the support platform 104. The slot hole 108 is formed in an inclining manner with respect to the support shaft-guiding hole 105 toward the upper end of the support shaft-guiding hole 105 before the punching member 111 begins to descend.

Furthermore, the width of the slot hole 108 is formed slightly larger than the diameter of the pivoting shaft 110 so that the pivoting shaft 110 is movable within a range of the slot hole 108 to absorb a frictional force and is formed so as to have allowance of movement. Also it is formed so that the amount of movement of the pivoting shaft 110 is minimized in order to avoid the distance between the fulcrum and the action point to be too far apart. With respect to the pivoting shaft 110, the slot hole 108 is to decrease the frictional force between the support shaft 112 and the support shaft-guiding hole 105 and to decrease the hole-piercing load (as described above, the movement of the length Lmax=od in FIG. 8A is absorbed).

Also, as shown in FIG. 7B and FIG. 9A, the support hole 109 of the connection part 107*b* of the handle 107 is formed near the slot hole 108 and in a front side position of the hole-piercing punch 100. Furthermore, the position of the support hole 109 is a position corresponding to the support shaft-guiding hole 105. Moreover, the support hole 109 is substantially circular shaped and holds the support shaft 112 so that the axial center position of the support shaft 112 is hardly displaced with respect to the handle 107.

Because the support hole 109 has a fixed positional relation with the support shaft 112, a manual force applied to the handle 107 as a power point is efficiently conveyed to the support shaft 112 as an action point. Moreover, the support hole 109 fixes the axial center position of the support shaft 112 in the handle 107, whereas the slot hole 108 holds the pivoting shaft 110 with allowance of movement.

That is, when the handle 107 is pivoted from the state shown in FIG. 9A to the state shown in FIG. 9B, 9C, the slot hole 108 having allowance of movement adjusts the positional relation of the handle 107 and the pivoting shaft 110. As a result, the slot hole 108 decreases the frictional force generated between the support shaft 112 and the support shaft-guiding hole 105 when the handle 107 is pivoted. Furthermore, as shown in FIG. 9B, when the support shaft 112 is positioned in the middle of the support shaft-guiding hole 105, due to the allowance of movement of the slot hole 108, the pivoting shaft 110 is caused to approach the end part of the support shaft-guiding hole 105, and the pivoting shaft 110 as a fulcrum and the support shaft 112 as an action point are caused to approach each other. With this constitution, it becomes possible to cause manual force applied to the handle 107 to act more strongly due to the support shaft 112. Furthermore, the hole-piercing punch 100 may fix the support shaft 112 at some position in the support hole 109 without comprising a support hole 109.

Behaviors as Well as Actions and Effects of the Hole-Piercing Punch

Next, hole-piercing work using the hole-piercing punch 100 related to the embodiment according to the present invention and behaviors as well as actions and effects of each of the mechanisms in the hole-piercing punch 100 are described using FIG. 9.

First, before causing the punching member 111 to descend, the user inserts paper sheets into the paper sheet feeder 113 and determines the position without applying any force to the handle 107.

After the user determines the position of the paper sheets in the paper sheet feeder 113, the user presses down the handle 107 in the direction toward the upper surface of the base 102 (R direction in FIG. 9A). Once the manual force is applied to the handle 107, as shown in FIG. 9A, the handle 107 starts pivoting with the pivoting axis 110 as a fulcrum. Due to the pivoting of the handle 107, the manual force applied to the handle 107 via the support hole 109 of the connection part 107*a* acts on the support shaft 112.

Once pressed down into the support hole 109, the support shaft 112 is guided by the support shaft-guiding hole 105 of the support platform 104 while maintaining the positional relationship with the handle 107 and descends in a direction that is orthogonal to the upper surface of the base 102. Then, the pivoting shaft 110 is pivoted accompanied by pivoting of the handle 107 while maintaining the positional relationship of the axial center thereof and the support platform 104. Furthermore, due to the allowance of movement of the slot hole 108 in the handle 107, the pivoting shaft 110 approaches the support shaft 112 by displacing the position with respect to the handle 107 while decreasing the frictional force of the support shaft 112 and the support shaft-guiding hole 105.

When the handle 107 is pivoted further and the support shaft 112 reaches an intermediate spot in the support shaft-guiding hole 105 as shown in FIG. 9B, the support shaft 112 is approached by the pivoting shaft 110 that has been inserted into the shaft hole 106 on the perpendicular bisector in the longitudinal direction of the support shaft-guiding hole 105. At the moment shown in FIG. 9B, or a moment after or before that, the blade part of the punching member 111 comes in contact with the paper sheets and starts the hole piercing.

Figure 4A:
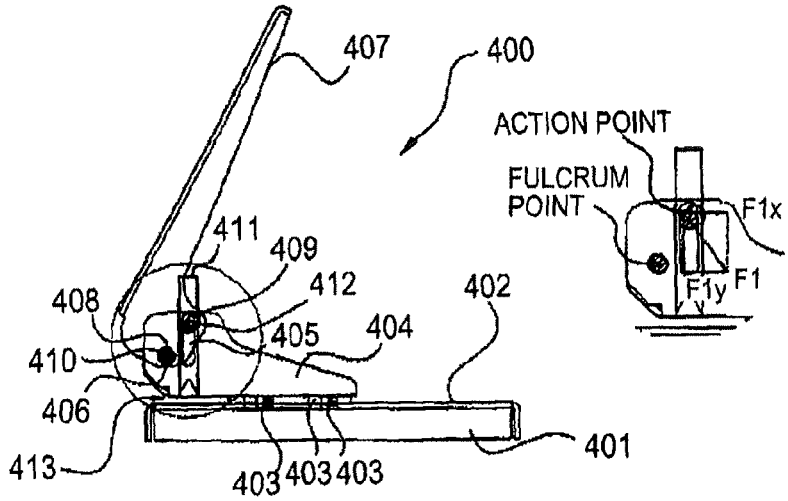
FIG. 4A Prior Art
FIG. 4A shows a lateral view and partially enlarged drawing when a punching member 411 of a conventional hole-piercing punch 400 begins to descend.
Figure 4B:
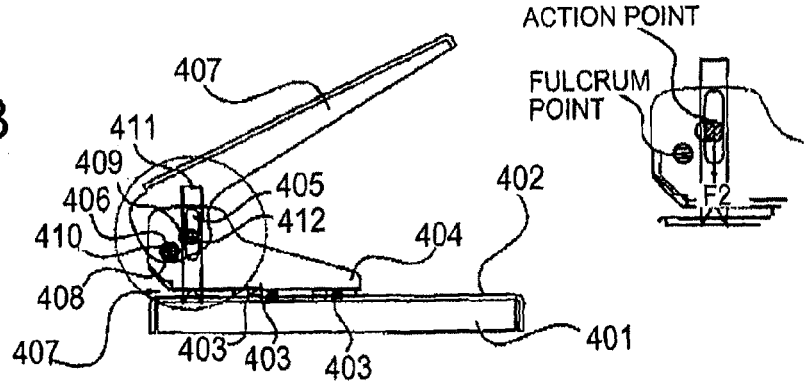
FIG. 4B Prior Art
FIG. 4B shows a lateral view and partially enlarged drawing when the maximum hole-piercing load is applied to the hole-piercing punch 400.
Figure 4C:
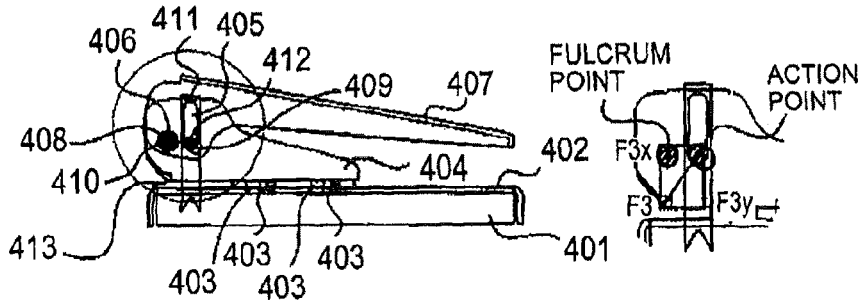
FIG. 4C Prior Art
FIG. 4C shows a lateral view and partially enlarged drawing when the punching member 411 of a conventional hole-piercing punch 400 completes the hole-piercing.

As described above, in the hole-piercing punch 100 according to the present embodiment, the support shaft 112 approaches the pivoting shaft 11 when the hole piercing starts through the punching member 111, that is, the moment of receiving the maximum hole-piercing load. Therefore, in the hole-piercing punch 100, because the manual force acting on the handle 107 acts more significantly through the punching member 111 via the support shaft 112, it becomes possible to decrease the hole-piercing load. Furthermore, as in the conventional hole-piercing punch 400 shown in FIG. 4, in comparison to a case in which a portion for conveying manual force to a support shaft (a slot hole 409 formed in a handle 407) is configured to have allowance of movement, in the hole-piercing punch 100 according to the present invention, because the position of the support shaft 112 and the handle 107 are not displaced, it becomes possible to cause the manual force to act efficiently.

When the user pivots the handle 107 further from the state in FIG. 9B, the support shaft 112 begins to descend from the intermediate position in the support shaft-guiding hole 105 to the lower end. When the user pivots the handle 107 further, as shown in FIG. 9C, the punching member 111 starts piercing holes in the paper sheets and then descends in the direction toward the base 102. Then, the blade part of the punching member 111 penetrates the paper sheets. Once the blade part of the punching member 111 penetrates the paper sheets, the blade part of the punching member 111 passes through the punch hole that has been formed in the top surface of the base 102 and reaches the waste storage part 101. In the hole-piercing punch 100 according to the present embodiment, the shaft hole 106 is formed on the perpendicular bisector of the support shaft-guiding hole 105. Therefore, in the transition of the support shaft 112 from the state in FIG. 9B to the state in FIG. 9C, it becomes possible to decrease the frictional force generated between the support shaft 112 and the support shaft-guiding hole 105.

In the hole-piercing punch 100 related to the embodiment according to the present invention described thus far, it is possible to decrease the frictional force in the handle 107 by the slot hole 108 that supports the pivoting shaft 110 so as to be movable and to decrease the hole-piercing load, because the manual force is efficiently conveyed by the support hole 109 for holding the support shaft 112. Furthermore, the hole-piercing punch 100 related to the present embodiment may decrease the maximum hole-piercing load due to the positional relationship of the support shaft-guiding hole 105 and the shaft hole 106 in the support platforms 104 as described above.

Furthermore, because the shaft hole 106 holds the axial center position of the pivoting shaft 110 so as to not be displaced with respect to the support platforms 104, the pivoting shaft 110 is not deviated from the support shaft 112 when the maximum hole-piercing load is applied. Therefore, in comparison to a conventional fulcrum-shifting punch (cf. FIG. 1), the hole-piercing punch 100 according to the present embodiment makes it possible to convey the manual force received by the handle 107 more significantly to the support shaft 112.

Moreover, in the hole-piercing punch 100 according to the present embodiment, the top cover 102*b* is formed to incline with respect to the bottom cover 102*a* of the base 102 (the upper surface opposite the bottom surface). Therefore, it is possible to narrow the angle formed by the handle 107 and the base 102, thereby improving operability in hole-piercing work by the hole-piercing punch 100.

Modified Example

Next, a modified example of the hole-piercing punch related to the embodiment described thus far is explained below.

In the hole-piercing punch 100 related to the present embodiment, the top surface of the handle 107 (surface of the side opposite the base 102 side) is formed as a plane, but the present invention is not restricted to this embodiment.

For example, a protruding part may be provided at the tip portion on the top surface of the handle 107 to form a handle part 107*c* inclining from the protruding part toward the top surface of the handle 107. By forming such a handle part 107*c* at the tip of the handle 107, in a step of pressing down the handle 107 for hole piercing, the tip of the handle 107 that is most distant from the support shaft 112 may be held, thus making it possible to enhance operability. Moreover, even without providing such a handle part 107*c*, the tip part of the handle 107 may be formed by warping in the direction deviating from the top surface, or a concave portion may be provided at the tip. The operability may be enhanced also by such a constitution.

What is claimed is:

1. A hole-piercing punch for piercing paper sheets entered from an entry portion, provided with a base platform, a support platform mounted uprightly from one surface of the base platform, and a handle member that is pivotably supported by the support platform, the entry portion being formed between the base platform and the support platform, comprising:

a shaft member in which the axial center position in the support platform is fixed by being inserted into a shaft hole formed in said support platform, a slot hole that is formed at one end of said handle member and has allowance of movement, into which said shaft member is inserted so as to be displaced with respect to the shaft member, a support shaft-guiding hole that is formed at the position of a tip of said handle member from said shaft hole of said support platform and has a longitudinal direction in a direction that is orthogonal to said one surface of said base platform, a support shaft that has a position fixed in said handle member by being inserted into a support hole formed in the handle member near said shaft member and at the same time near a line connecting the tip and the shaft member of said handle member, and is guided into said support shaft-guiding hole to be pressed down via the support hole as a result of pressing down the handle, and a punch member that has a blade part at one end of said one surface of said base platform and moves along with the support shaft while being held by the support shaft so as to be orthogonal to said support shaft for piercing the paper sheets entered from the entry portion, wherein the axial center of said shaft member is positioned near a perpendicular bisector of a segment connecting both ends of said support shaft-guiding hole, when the support shaft is placed on an upper edge of the support shaft-guiding hole, the blade part is above the entry portion of the paper sheets;

movement of the support shaft to a bottom edge of the support-guiding hole for piercing the paper sheets causes the blade part to reach the support platform; and said slot hole moves away from said support shaft due to rotation of said handle member when said support shaft is pressed down with the guide of said support shaft-guiding hole.

2. A hole-piercing punch comprising:

a support platform is mounted uprightly by being fixed to one surface of a base platform, a shaft hole provided at a position away from said one surface in said support platform, a support shaft-guiding hole provided near said shaft hole in said support platform and extending in a direction substantially orthogonal to said one surface of said base platform, a support shaft inserted into said support shaft-guiding hole so as to be substantially parallel to said one surface of said base platform, a punching member of a column shape, wherein one end thereof has a blade part, while the other end is fixed to said support shaft so that the longitudinal direction of the blade part is orthogonal to said one surface of said base platform for piercing paper sheets entered from an entry portion formed between the base platform and the support platform, a shaft member for which the axial center position thereof with respect to said support platform is fixed while being supported by being inserted into a shaft hole so as to be substantially parallel to said one surface of said base platform, and a handle member that has its shaft member inserted into one end thereof, has a slot hole having allowance of movement that is displaceable with respect to the shaft member and a support hole for fixing and supporting the axial center position of said support shaft near the slot hole, and has been made pivotable with said shaft member as a fulcrum and, wherein the position of said shaft member is to be situated so that a triangle is formed as a isosceles triangle with the axial center position of the shaft member as a vertex and said support shaft-guiding hole as a base platform, when the support shaft is placed on an upper edge of the support shaft-guiding hole, the blade part is above the entry portion of the paper sheets;

movement of the support shaft to a bottom edge of the support-guiding hole for piercing the paper sheets causes the blade part to reach the support platform; and said slot hole moves away from said support shaft due to rotation of said handle member when said support shaft is pressed down with the guide of said support shaft-guiding hole.

3. The hole-piercing punch according to claim 2, wherein the shortest distance from the axial center position of said shaft member to said support shaft-guiding hole is shorter than the length of the support shaft-guiding hole.

4. The hole-piercing punch according to claim 2, wherein said one surface of said base platform is formed so as to have a downward inclination from said shaft member side to the other end.

5. The hole-piercing punch according to claim 3, wherein said one surface of said base platform is formed so as to have a downward inclination from said shaft member side to the other end.

6. The hole-piercing punch according to claim 2, wherein a handle part acting as a surface that is opposite said base platform of said handle member is provided, and has a downward inclination.

7. The hole-piercing punch according to claim 3, wherein a handle part acting as a surface that is opposite said base platform of said handle member is provided, and has a downward inclination.

8. A hole-piercing punch comprising:

a shaft member that is horizontally fixed to a first support column provided on the surface of a base platform, a handle part wherein one end of said handle part has a hole with a size that has allowance of movement that is displaceable with respect to the shaft member, into which the shaft member has been inserted and the other end of said handle part is holdable, a second support column that is provided near the other end direction of said handle part near said first support column on the surface of said base platform and has a guiding groove vertical to the surface of said base platform, wherein a horizontal shaft that has been inserted horizontally into the guiding groove is vertically guided and an entry portion of paper sheets is formed between the second support column and the base platform, a punching member of a column shape, wherein one end of said punching member has a blade part, while the other end of said punching member is fixed to said horizontal shaft so that the blade part becomes vertical to the surface of said base platform for piercing paper sheets entered from an entry portion, a shaft-support member wherein the horizontal shaft is fixed to the one end of said shaft-support member, while the other end of said shaft-support member is fixed to the lower part of said handle part, wherein the punching member is to be constituted so that a triangle with the axial center position of said shaft member being the vertex and said guiding-groove being the base forms an isosceles triangle, said handle part is configured to be pivotable with said shaft member as a fulcrum, when the shaft-support member is placed on an upper edge of the guiding groove, the blade part is above the entry portion of the paper sheets;

movement of the shaft-support member to a bottom edge of the guiding groove for piercing the paper sheets causes the blade part to reach the supportplatform; and said hole moves away from said support-shaft member due to rotation of said handle member when said support shaft is pressed down with the guide of said support shaft-guiding hole.

9. The hole-piercing punch according to claim 8, wherein said first support column and said second support column are united.

* * * * *